US005870026A

United States Patent [19]

Challenger

[11] Patent Number: 5,870,026

[45] Date of Patent: Feb. 9, 1999

[54] BRUSH WEAR INDICATOR

[75] Inventor: Keith C. Challenger, Greer, S.C.

[73] Assignee: The Morgan Crucible Company plc, Berkshire, England

[21] Appl. No.: 892,645

[22] Filed: Jul. 15, 1997

[51] Int. Cl.[6] ..... G08B 21/00

[52] U.S. Cl. ..... 340/648; 340/635; 340/679; 310/245; 310/249

[58] Field of Search ..... 340/635, 648, 340/679, 641, 642, 691; 310/242, 245, 248, 249, 228

[56] References Cited

U.S. PATENT DOCUMENTS

| | | | |
|---|---|---|---|
| 2,098,062 | 11/1937 | Palmer | 310/249 |
| 3,153,164 | 10/1964 | Jop | 310/249 |
| 4,316,186 | 2/1982 | Purdy, et al. | 340/648 |
| 4,333,095 | 6/1982 | Silva | 340/679 |
| 4,344,072 | 8/1982 | Harper, Jr. | 340/648 |
| 4,536,670 | 8/1985 | Mayer | 310/249 |
| 4,542,374 | 9/1985 | Kollmannsberger et al. | 340/648 |
| 4,636,778 | 1/1987 | Corkran et al. | 340/648 |
| 4,646,001 | 2/1987 | Baldwin et al. | 324/652 |
| 4,739,208 | 4/1988 | Kimberlin | 310/248 |
| 4,950,933 | 8/1990 | Pipkin et al. | 310/239 |
| 5,488,261 | 1/1996 | Swoboda et al. | 310/245 |

FOREIGN PATENT DOCUMENTS

| | | | |
|---|---|---|---|
| 0072693 | 2/1986 | European Pat. Off. | 340/648 |
| 2319880 | 2/1977 | France | 340/648 |
| 3007887 | 9/1981 | Germany | 340/648 |
| 4137384 | 4/1993 | Germany . | |

OTHER PUBLICATIONS

Brochure entitled "Morganite TransTronic Brushwear Monitoring System" (four pages; available to Applicant before Jul. 15., 1997).

Brochure entitled "Electronic Brush Wear Monitor Morganite" (four pages; available to Applicant before Jul. 15, 1997).

*Primary Examiner*—Jeffery A. Hofsass
*Assistant Examiner*—Van T. Trieu
*Attorney, Agent, or Firm*—Dean W. Russell; Kilpatrick Stockton LLP

[57] ABSTRACT

Indicators of incremental brush wear are disclosed. Versions of the indicators may comprise signal wire assemblies embedded in brushes so that they continuously contact rotating components of electrical machines. Each such wire assembly typically is chosen so that its nominal electrical resistance differs from that of its corresponding brush, while its mechanical properties remain similar to those of the brush.

28 Claims, 1 Drawing Sheet

BRUSH WEAR INDICATOR

This invention relates to brushes designed to transfer current in certain electrical machinery and more particularly to indicators of characteristics, such as the wear, of such brushes in use.

BACKGROUND OF THE INVENTION

Certain motors, generators, and other rotating electrical machinery conventionally include commutators or analogous rotor contact surfaces. These machines additionally utilize low-resistance brushes, typically positioned in holders, to transfer electric current between the commutators and stationary components of the devices. Because the brushes of a machine frictionally contact its rotating commutator, wear is likely to occur. To avoid (or at least reduce) erosion of the commutator—which often is constructed of copper bars—corresponding brushes are made of softer materials, typically carbon and graphite. As a consequence, conventional brushes deteriorate in use.

Rather than protecting the commutator surface, however, excessive brush wear may damage it. If substantially or completely eroded, the relatively soft carbon and graphite of the brush no longer is available to engage the commutator surface. Instead, the surface of the commutator may contact the copper shunt wire typically connected to the brush or some portion of the brush holder itself. Either contact is likely to be sufficiently detrimental to continued operation of the commutator that premature replacement of the brush may be desirable.

Notwithstanding the potential desirability for this reason of replacing brushes before they wear substantially, disadvantages of doing so exist. In particular, prematurely replacing brushes obviously increases over time the cost of materials, as more brushes than optimal must be used to produce the same electrical output. Additionally, stopping rotation of the machinery to replace brushes ceases output entirely.

Monitoring systems were thus created to address these brush-wear issues. Exemplary existing systems are illustrated in FIGS. 1–4 of U.S. Pat. No. 4,316,186 to Purdy, et al., which patent is incorporated herein in its entirety by this reference. Each system includes a sensing wire embedded longitudinally in part of its corresponding brush. Both the periphery and the tip of the sensing wire are electrically insulated from the brush, thereby isolating the wire electrically from current flowing through the brush. The tip, moreover, is remote from the edge of the brush that initially contacts the commutator surface.

As the brush of the Purdy patent wears in use, the commutator surface eventually contacts the insulated tip of the sensing wire. Continued use of the brush causes the insulation to erode from the tip of the wire, exposing the wire to the surface of the commutator. Upon this exposure, the voltage present on the commutator surface also becomes present on the sensing wire, providing an electrical signal indicating that the contact has occurred. Because the sensing wire extends further through the brush than the current-carrying output leads, it contacts the commutator surface—and thus senses such contact—before the (harder) output leads do so. According to the Purdy patent:

> This is to allow the dynamoelectric machine to be operated until the next opportunity for maintenance, and brush replacement, of the dynamoelectric machine, rather than causing a sudden shut down of the dynamoelectric machine, which is not desirable in most applications for dynamoelectric machines.

See col. 5, lines 56–62.

German Patentschrift No. 4137384 appears to disclose another existing wear-indicating system. When the sensing wire of the system disclosed in the German document contacts the commutator and has its insulation removed frictionally, it begins conducting electricity. The conducted electricity illuminates a warning light, effectively indicating that further use of the brush might damage the commutator. Other uses of the conducted electrically may be made as well.

In each of the above-referenced systems, the sensing wire functions as a discrete, two-state device: if the brush has worn to a predetermined level sufficient to cause the sensing wire to contact the rotating surface, the wire conducts electricity; if the brush has not, the sensing wire does not conduct. No continuous or incremental information respecting brush erosion is thus supplied by these systems. None, moreover, necessarily operates reliably under conditions where the sensing wire is stressed. If the sensing wire breaks under such stress, for example, it will fail to provide the requisite signal indicating that the insulation at its tip has been worn away. Similarly, if the sensing wire separates from the brush, no wear signal will be supplied.

SUMMARY OF THE INVENTION

The present invention avoids these and other problems associated with existing monitoring systems. By contrast with those discussed above, the invention includes a system for sensing incremental wear of a brush in use. Thus, information concerning brush erosion is available continuously when desired, rather than in merely the two-state, "on-off" format of the existing systems.

Embodiments of the invention contemplate forming brushes having bodies made of carbon or other appropriate material, with one or more shunts, or output leads, extending from a face of each brush other than that which contacts a commutator in use. As in conventional brushes, the shunts are designed to conduct the main load current of the brushes and comprise copper wire inserted into holes drilled in the carbon brush bodies. Typically, compacted copper or graphite powder is tamped into the holes surrounding each shunt and then cured to form a mechanical and low-resistance electrical connection between the shunt and carbon body. The invention is not necessarily limited to brushes of this type, however, but rather in appropriate circumstances may be used with other brushes or devices.

Like many existing indicator systems, the present invention includes an insulated wire assembly embedded in the body of the brush. However, while existing systems intentionally space their sensing wires remote from the initial contact edges of the corresponding brushes, embodiments of the present invention do not. Instead, the wire assembly of the present invention may extend through the entire length of the brush, terminating at the surface of the brush intended to contact the commutator.

The innovative wire assembly comprises an elongated rod of material having a (relatively) high resistance and a signal wire electrically connected to the rod. In some embodiments of the invention, the rod is formed of high-resistance carbon or graphite. By utilizing this type of carbon or graphite, the rod may exhibit electrical characteristics distinct from the corresponding brush body, while maintaining the same general mechanical properties (particularly softness) of the body of the brush. Thus, notwithstanding repeated contact with the rod, the commutator is unlikely to sustain wear or damage in use beyond that normally associated with utilizing a traditional carbon brush.

Versions of the invention additionally may include a controller or other device for monitoring the brush output. Such device, when present, may determine the voltage ("$V_{ref}$") across the commutator and brush via the shunt connected to the brush body and compare it to the voltage ("$V_S$") measured via the signal wire connected to the rod. Such comparisons may be performed either continuously or at discrete intervals as appropriate or desired. The respective voltages additionally may be measured with respect to a separate alternating-current (AC) signal applied across the brush.

Because the electrical resistance of the rod is intentionally chosen to be significantly higher than that of the body of the brush, $V_S$ initially should be less than $V_{ref}$. When the resistance of the rod is uniform throughout its length, moreover, the signal voltage $V_S$ will vary in direct proportion to the wear of the rod (and therefore of the brush as well). Although voltage $V_{ref}$ too arguably will vary as a function of brush wear, any such variation is likely to be slight compared to the variation of $V_S$ and thus is effectively independent of the variation. Accordingly, by comparing $V_S$ over time with $V_{ref}$, the controller or other device can detect the amount of wear the brush has sustained. When $V_S$ becomes approximately equal to $V_{ref}$, the rod is fully worn. If the length of the rod is chosen to match the useful length of the brush, equalization of $V_{ref}$ and $V_S$ likewise can signal the end of its useful life.

Although rod—and therefore brush—erosion may be determined with reference to $V_S$ directly (i.e. without comparison with $V_{ref}$), using $V_{ref}$ in the determination reduces the possibility of erroneous results. Under standard operating conditions, the electrical resistance at the brush/commutator interface of a rotating machine may vary significantly over time. Such variation, or "contact drop," which is substantially independent of brush wear, nonetheless may affect the value of $V_S$ as a function of time and erroneously suggest that the rod is longer or shorter than is actually the case. Because the phenomenon of contact drop affects $V_{ref}$ as well, comparing $V_S$ to $V_{ref}$ can correct for it and thereby increase the accuracy of the result.

Alternate embodiments of the present invention may include segmented rods. If such rods are present, each segment may have an electrical resistance that differs from those of its adjacent segments. As a particular segment completely erodes in use and its next adjacent segment begins contacting the commutator, the value of $V_S$ will change significantly. Sensing such a change in $V_S$ (including in comparison to $V_{ref}$) would thus provide information about the wear of the rod and thus of the corresponding brush. In any embodiment, furthermore, the length of the rod need not match exactly the useful length of the brush, and neither the tip of the rod nor, in certain cases, the periphery adjacent the tip, need be electrically isolated from the brush. Similarly, the wire assembly need not extend through the entire length of the brush, but rather may exit the brush at any suitable point along any appropriate face.

It is therefore an object of the present invention to provide systems and techniques for sensing, detecting, monitoring, measuring, or determining changes in characteristics of a current-carrying brush or other device.

It is another object of the present invention to provide systems and techniques for detecting erosion of a brush as a function of time or use.

It is an additional object of the present invention to provide systems and techniques for detecting such erosion in which a rod, having a higher nominal resistance than the brush, contacts the surface of a rotating component of an electrical machine.

It is a further object of the present invention to provide systems and techniques for utilizing signal wire assemblies to provide continuous information about characteristics of the brushes in which they are embedded.

It is also an object of the present invention to provide systems and techniques for monitoring brush wear in which signals are received from both the embedded wire assemblies and the main output leads.

It is yet another object of the present invention to provide systems and techniques for determining brush wear in which a signal wire assembly has similar mechanical properties to the brush in which it is embedded.

Other objects, features, and advantages of the present invention will become apparent with reference to the remainder of the text and the drawings of this application.

DETAILED DESCRIPTION

Figure 1:
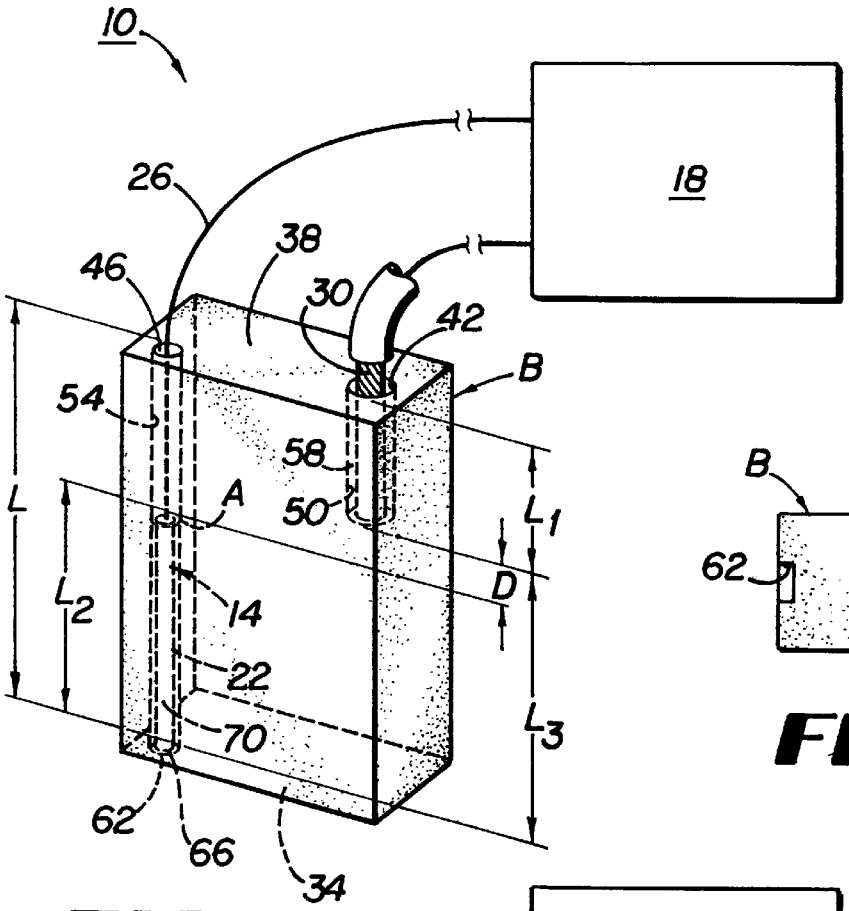
FIG. 1 is a perspective, partially schematicized view of a system of the present invention and its corresponding brush.

FIG. 1 illustrates a system 10 of the present invention. System 10, shown in connection with an exemplary brush B, may include wire assembly 14 and processing equipment 18. Wire assembly 14, in turn, comprises rod 22 and signal wire 26 electrically connected to rod 22 at point A. Those skilled in the art will recognize that rod 22 need not necessarily be cylindrical, but rather may assume any appropriate shape consistent with the objects of the invention.

Also shown in FIG. 1 is shunt 30, usually a stranded copper wire which functions as the primary output lead for brush B. One or more additional shunts may be incorporated into brush B if appropriate, as is true for conventional current-carrying brushes. Principles of operation of system 10 remain identical, however, notwithstanding the number of shunts present in the brush B of interest.

In the version of system 10 detailed in FIG. 1, brush B includes face 34, which in use is intended to contact a commutator or other rotating component of an electrical machine. Brush B additionally has a face 38 opposite face 34, between which is defined a length L. Although not illustrated in FIG. 1, a spring-loaded or other holder typically is used to retain brush B in an appropriate position relative to the rotating element of the machine.

Present on face 38 are two openings 42 and 46, each being an end of a corresponding bore 50 or 54 created in brush B. Through opening 42, shunt 30 is inserted into bore 50 a distance $L_1$ obviously less than length L. Compacted copper or graphite powder 58 may then be tamped into bore 50 and cured to retain shunt 30 in place. Such compacted and cured powder 58 effectively connects shunt 30 to the remainder of brush B both mechanically and electrically with low resistance to current flow. Although shown in FIG. 1 as protruding from face 38, shunt 30 may extend from any face of brush B other than face 34.

By contrast with bore 50, which need not extend through brush B beyond distance $L_1$, bore 54 typically extends throughout the entire length L of brush B, terminating at opening 62 present on face 34. Wire assembly 14 thereafter is inserted into this bore 54 so that, in many embodiments, tip 66 of rod 22 is substantially flush with face 34. Doing so immediately exposes rod 22 to the rotating element of the electrical machine, which exposure continues until the friction associated with it completely erodes the rod. In certain circumstances bore 54 does not need to extend the entire length L of brush B, however, as signal wire 26 may beneficially exit brush B other than through face 38. Moreover, rod 22 need not always extend to face 34, although in such cases information concerning the wear of brush B might not immediately be available.

Rod 22 is formed of material having a significantly higher electrical resistance (e.g. ten to twenty times in some embodiments) than the remainder of brush B. In preferred embodiments of system 10, however, rod 22 comprises material having at least some mechanical properties similar to those of the remainder of the brush B. In particular, if the hardness of rod 22 approximates that of face 34, the rotating component of the electrical machine is unlikely to sustain any additional damage through its frictional contact with the rod. As the body of brush B is typically made of carbon and graphite, forming rod 22 of a relatively high resistance carbon or graphite material is likely to produce satisfactory results.

Rod 22 extends from point A a length $L_2$ to face 34. As is apparent from FIG. 1, distance $L_2$ is less than length L. It also is slightly less than distance $L_3$ of FIG. 1, which is the difference between length L and distance $L_1$. As a consequence, a relatively short length "D" of brush B will remain even after rod 22 is completely worn. So long as brush B is replaced while any portion of this length D remains, shunt 30 continues unexposed to the surface of the commutator or other rotating element of the electrical machine and thus cannot damage it.

Both signal wire 26 and periphery 70 of rod 22 may (and usually must) be electrically insulated from the remainder of brush B. The insulation surrounding periphery 70 of rod 22 should be sufficiently soft that it too is worn through contact with the rotating element of the machine, so that at any given time the end of rod 22 most distant from point A remains exposed to the rotating element. After wire assembly 14 is inserted into bore 54, it too may be held in place through use and curing of graphite powder, an epoxy, or some other suitable substance. Alternatively, wire assembly 14 may be retained in position through an interference fit, especially when shrink tubing or similar insulation is employed.

As noted earlier, shunt 30 provides the primary electrical output of brush B and thus connects to one or more devices designed to utilize such electrical output. FIG. 1 details additional connection of shunt 30 to processing equipment 18, which may (but need not) be a device generically termed a "controller." Equipment 18, if present, is intended to detect and utilize the voltage $V_{ref}$ existing across brush B and the rotating component of the machine (as discussed earlier). Because signal wire 26 likewise may be connected to equipment 18, such equipment similarly may detect and utilize the voltage $V_S$ existing across rod 22 and the rotating component.

Rod 22 of FIG. 1 has substantially uniform electrical resistance throughout its (initial) length $L_2$. Thus, voltage $V_S$ detected by equipment 18 will vary as a function of time in direct proportion to the length of rod 22. By examining this variation, equipment 18 may continuously provide, as output, information concerning the wear of rod 22 and of its corresponding brush B as contact face 34 erodes toward point A. The reliability of this information may be enhanced by having equipment 18 compare voltage $V_S$ to the voltage $V_{ref}$ present at the same instant of time which, as noted above, reduces the effect of the "contact drop" phenomenon often seen at contact interfaces of rotating machines. In either circumstance, system 10 is capable of providing either discrete or continuous information concerning the wear of brush B throughout its useful life.

In some embodiments of the invention, equipment 18 will display (visually or otherwise) the percentage "P" of life remaining for brush B. Such percentage may be obtained at a particular time "T" by having equipment 18 perform the following calculation:

$$P(T) = \frac{V_{ref}(t = T) - V_s(t = T)}{V_{ref}(t = 0)} \times 100$$

where $V_{ref}$ is the initial steady-state voltage present across the rotating component and brush As the length of rod 22 approaches zero—thereby signalling the end of the useful life of brush B—the value of voltage Vs will approach that of $V_{ref}$, making the numerator of the above-written equation approximately zero as well. When percentage P decreases to zero, a length D of brush B continues to cover shunt 30 and prevent exposure of it to the rotating element. Although distance D may be any selected value, preferred embodiments of system 10 have a distance D of approximately one-eighth inch.

Figure 2:
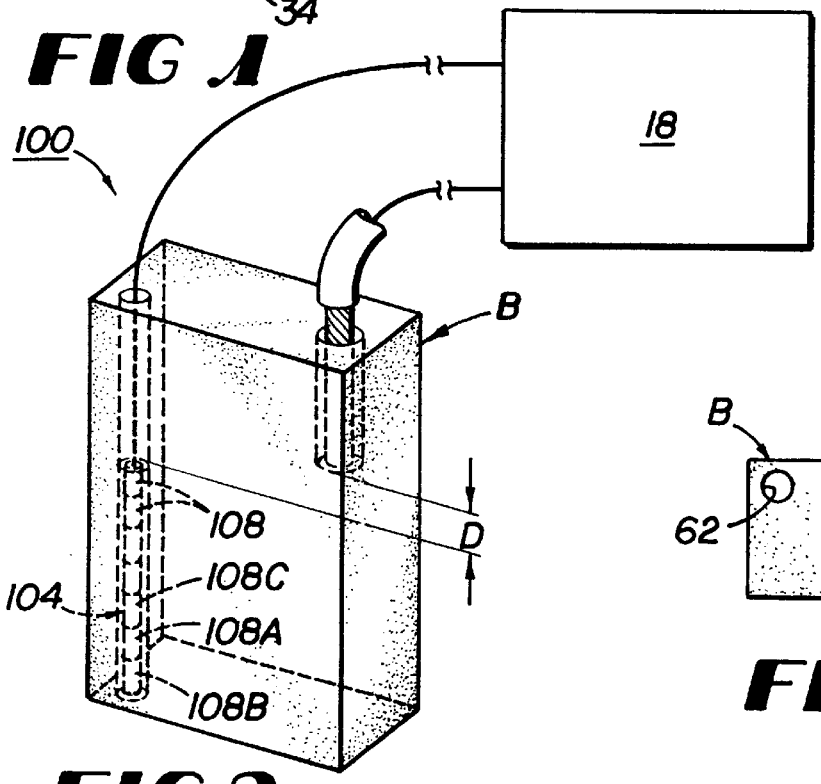
FIG. 2 is a perspective, partially schematicized view of an alternate system of the present invention and its corresponding brush.

FIG. 2 depicts an alternate system 100 of the present invention. System 100 is substantially identical to system 10, except that rod 104 does not have uniform electrical resistance throughout its length. Instead, rod 104 is composed of multiple segments 108, any given one 108A having an electrical resistance different from those of its adjacent segments 108B and 108C. Thus, the value of voltage $V_S$ measured by equipment 18 will remain approximately constant until segment 108B, for example, is completely eroded, after which its value will change measurably. Similarly, when segment 108A erodes entirely, voltage $V_S$ will again experience a measurable change. If the lengths of the segments 108 are known or determinable, these step-wise modifications of voltage $V_S$ provide incremental information concerning the overall length of rod 104.

Figure 3A:
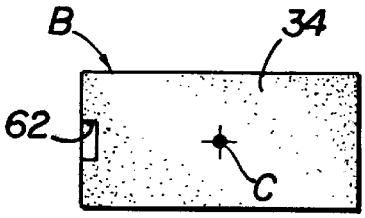
FIGS. 3A and 3B are plan views of contact faces of brushes of the types shown in FIGS. 1 and 2.
Figure 3B:
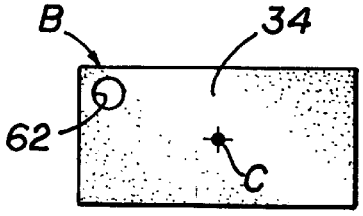

Shown in FIGS. 3A and 3B are preferred placements of opening 62 on face 34. In FIG. 3B, cylindrical opening 62 appears near the axial edge of brush B, remote from the center point C of face 34. Placement of opening 62 in this manner reduces the likelihood that tip 66 will disrupt significantly the electrical operation of the rotating component. Alternate opening 62 of FIG. 3A is illustrated as being a groove existing along the axial edge of brush B, in which a flat rod 22 or 104 may be placed. Again, however, opening 62 is remote from center point C to minimize disruption in electrical operation.

Voltages $V_{ref}$ and $V_S$ may be measured based on flow of direct current (DC) through the brush. Alternatively, a low-level AC signal (e.g., five Volts at sixty Hertz) may be applied across the brush and used to determine these voltages. By examining the output of shunt 30 and signal wire 26 at the selected frequency, an AC voltage drop related to the length of rod 22 can be obtained or measured with minimal error notwithstanding contact drop and other time-varying electrical aspects of rotating machines.

Systems 10 and 100 thus solve problems such as those specified earlier. Breakage of wire assembly 14, for example, will be readily apparent promptly after occurrence, as voltage $V_S$ will immediately change from non-zero to zero. Additionally, replacement or maintenance of brush B can also be scheduled more easily, as information respecting the remaining life of the brush is available as desired. The foregoing is, therefore, provided for purposes of illustrating, explaining, and describing embodiments of the present invention that resolve issues present in certain existing indicators. Modifications and adaptations to these embodiments will be apparent to those skilled in the art and may be made without departing from the scope or spirit of the invention.

What is claimed is:

1. A system for indicating the wear of a brush having (i) a first surface for contacting a rotating component of a machine, which first surface wears as a result of such contact, (ii) a length, which decreases as a result of such wear of the first surface, (iii) an electrical resistance, and (iv) a lead embedded therein remote from the first surface, the system comprising:

a. means, having an electrical resistance differing from that of the brush, for contacting the rotating component in use; and b. means for conveying electrical signals, which signals (i) vary as a function of the decreasing length of the brush and (ii) are generated by contact of the contacting means with the rotating component, to a device for processing.

2. A system according to claim 1 in which the contacting means comprises a rod embedded in but electrically insulated from the brush.

3. A system according to claim 2 in which the conveying means comprises a wire electrically connected to the rod.

4. A system according to claim 3 further comprising the processing device to which the wire is electrically connected.

5. A system according to claim 4 in which the processing device comprises means for comparing the magnitudes of electrical signals received from the wire and the lead.

6. A system according to claim 5 in which the processing device comprises means for continuously determining, based on the magnitudes of electrical signals received from the wire and the lead, the unworn length of the brush.

7. A system according to claim 2 in which the lead has an end embedded in the brush to a first initial distance from the unworn surface and in which the rod initially has a length less than both the unworn length of the brush and the first initial distance.

8. A system according to claim 7 in which the rod extends to the first surface prior to any wear of the first surface.

9. A system according to claim 2 in which the brush has a second surface and the first surface defines an opening which is an end point of a bore extending the length of the brush from the second surface to the first surface.

10. A system according to claim 2 in which the electrical resistance of the rod is substantially uniform along its length.

11. A system according to claim 2 in which the electrical resistance of the rod varies at discrete intervals along its length.

12. A system according to claim 2 in which the rod extends to the first surface prior to any wear of the first surface.

13. A system according to claim 1 in which the contacting means extends at least substantially to the first surface prior to any wear of such surface.

14. A brush comprising:

a. a body formed, at least in part, of material having a relatively low electrical resistance selected from the group consisting of carbon and graphite, and comprising:

i. a first face for frictionally contacting a surface of a rotating component of an electrical machine in use, which first face wears as a result of the frictional contact; and ii. a second face opposite the first face, the first and second faces defining the length of the body;

b. at least one lead embedded in the body and spaced therein a selected distance from the first face;

c. an assembly mechanically connected to or embedded within but electrically insulated from the body, comprising:

i. an elongated rod formed, at least in part, of material having an electrical resistance different from that of the body but yet selected from the group consisting of carbon and graphite and having an end that frictionally contacts the surface of the rotating component in use, which rod wears with the first face as a result of the frictional contact to provide an electrical signal having a characteristic dependent on the length of the brush remaining at a particular time; and ii. means, electrically connected to the rod, for conveying the electrical signal for further processing of the characteristic dependent on the remaining length of the brush.

15. A brush according to claim 14 in which the length of the rod is less than the distance that the lead is spaced from the first face.

16. A brush according to claim 14 in which the electrical resistance of the rod is substantially uniform along its length.

17. A system according to claim 14 in which the electrical resistance of the rod varies at discrete intervals along its length.

18. A method of making a brush comprising:

a. forming a substantially solid body of an electrically conductive material, the body having an initial contact face and a length;

b. creating in or along the body first and second bores, the first bore extending to the initial contact face;

c. inserting into the first bore a rod which extends to the initial contact face;

d. inserting into the second bore a lead, which lead does not extend substantially to the initial contact face; and e. fixing the positions of the rod and lead within the respective first and second bores.

19. A system for indicating the wear of a brush having (i) a first surface for contacting a rotating component of a machine, (ii) an electrical resistance, (iii) a lead embedded therein and terminating at a first initial distance from the first surface, and (iv) a useful length which decreases as a function of its use and terminates before the lead can contact the rotating component of the machine, the system comprising:

a. means, extending at least substantially to the first surface and having an electrical resistance differing from that of the brush, for contacting the rotating component in use;

b. a processing device; and c. means, comprising a wire, for conveying electrical signals generated by contact of the contacting means with the rotating component to the processing device; and in which the processing device comprises means for continuously determining, based on the magnitudes of electrical signals received from the wire and the output lead, the remaining useful length of the brush.

20. An assembly comprising an electrical current contact block having a contact surface designed, in use, to contact and preferentially wear with respect to a relatively moving electrical part, an electrical conductor connected thereto remote from the contact surface and a wear sensor element, wherein the wear sensor element (i) is of a preferentially wearable material of higher electrical resistance than that of the contact block, (ii) is electrically insulated from the contact block and (iii) extends to proximate the contact surface thereof; whereby, in use, the separation between the contact surface and the electrical conductor may be sensed by the wear sensor element as the block wears.

21. An assembly as specified in claim 20, wherein the wear sensor element is of a material having at least some mechanical properties similar to that of the electrical current contact block.

22. An assembly as specified in claim 21, wherein the hardness of the wear sensor material is approximate to that of the electrical current contact block.

23. An assembly as specified in claim 20, wherein the electrical current contact block is an electrical brush to make continuous electrical contact between rotating and stationary parts of an electric machine, the electrical conductor is a shunt and the wear sensor element is a rod having a sensor wire attached thereto; both the brush material and the rod material being selected from the group consisting of carbon and graphite.

24. An assembly as specified in claim 23, wherein the wear sensor rod extends through the brush to the contact surface.

25. An assembly as specified in claim 23, wherein the electrical resistance of the wear sensor rod is substantially uniform along its length.

26. An assembly as specified in claim 23, wherein the electrical resistance of the wear sensor rod varies at discrete intervals along its length.

27. An assembly as specified in claim 23, wherein the unworn rod has an electrical resistance between ten and twenty times higher than that of the unworn brush.

28. An assembly as specified in claim 23, wherein the unworn sensor rod is shorter than the separation between the unworn contact surface and the shunt connection; whereby, as the brush wears in use, the sensor wire will contact the rotating machine part before the shunt.

* * * * *